United States Patent [19]

Vasiliou

[11] 4,192,327

[45] Mar. 11, 1980

[54] HAIR ROLLER WITH CLIP, AND METHOD OF USE

[76] Inventor: Anthony E. Vasiliou, 241 Cardinal St., Wheeling, W. Va. 26003

[21] Appl. No.: 705,127

[22] Filed: Jul. 14, 1976

[51] Int. Cl.[2] ..... A45D 2/26

[52] U.S. Cl. ..... 132/41 A; 132/41 B; 132/41 C

[58] Field of Search ..... 132/38, 40, 41, 42, 132/4

[56] References Cited

U.S. PATENT DOCUMENTS

| | | | |
|---|---|---|---|
| 3,057,366 | 10/1962 | Fink | 132/48 |
| 3,241,561 | 3/1966 | Richmond | 132/40 |
| 3,291,142 | 12/1966 | Green et al. | 132/40 |
| 3,404,694 | 10/1968 | Hammel | 132/40 |
| 3,916,919 | 11/1975 | Giordano | 132/40 |

*Primary Examiner*—G. E. McNeill
*Attorney, Agent, or Firm*—Ulle C. Linton

[57] ABSTRACT

In curling the hair, strands of hair are wound round an apertured cylindrical roller and secured thereon until set. For securing the wound strands, an arm mounted on a slider within the roller is movable from an axial withdrawn position in which it is clear of the wound hair, to a holding position in which it overlies and holds the hair against the roller. The arm can be moved to a stored condition within the roller. A preferred embodiment has a spring-loaded clip operable by grasping handle portions between finger and thumb.

7 Claims, 6 Drawing Figures

STORING POSITION

HAIR ROLLER WITH CLIP, AND METHOD OF USE

This invention relates to a hair rolling and holding device, for use in curling the hair.

BACKGROUND OF THE INVENTION

Various methods are used in wrapping, rolling or curling hair around a roller, such as a cylinder roller opened at both ends. A holder device must be used, such as a pin or clip, to secure the roller and maintain the hair in proper position while it is setting.

Rollers must be kept or stored on a rack or in a compartment, and the pins and clips in another compartment. The hairdresser must obtain a roller from one compartment, then place the roller in position ready to roll hair, then obtain a clip or pin from another compartment, open the clip or pin, place it on the roller, insert the clip or pin after rolling the hair, and then repeat the same movements when the hair is dry and ready for combing.

The difficulties and problems that can arise from all of the above movements and unnecessary steps has been a time-consuming and costly problem for the hairdressing profession. This also is a problem for women who roll and style their own hair using these methods and the various apparatus sold in the consumer market.

OBJECT OF THE INVENTION

A first object of the invention is to provide an improved hair roller which is provided with integrally associated means which are readily applicable to retain the hair wound on the roller.

A second object is to provide a method of use of the improved roller.

SUMMARY OF THE INVENTION

According to a first aspect of the present invention, a hair rolling and holding device, for use in curling the hair, comprises in combination a hollow roller to receive strands of hair wound externally about it, a clip to engage with and retain strands of hair wound about the roller, said clip including a slider movable axially within the roller between a first end position of movement and a second end position of movement, mounting means extending axially from the slider, and an arm carried on said mounting means remote from the slider and extending axially towards the slider, the extent of axial movement of the slider and the positioning and length of the arm being such that in said first end position the arm is withdrawn axially from the region of the hair-receiving surface of the roller, and in said second end position of movement the arm can overlie said hair-receiving surface to engage with strands of hair wound thereon.

According to a second aspect of the present invention, a method of curling the hair includes the steps of placing a hollow roller against the tips of strands of hair to be curled and winding said strands externally about the roller, moving a clip, including a slide movable axially within the roller and a mounting means extending axially from the slider and an arm carried on the mounting means remote from the slider and extending axially towards the slider, from a first end position of movement with respect to the roller, in which the arm is remote from the hair-receiving surface of the roller, into a second end position of movement with respect to the roller, in which the arm overlies the hair-receiving surface of the roller and engages with and holds the strands of hair wound thereon.

DESCRIPTION OF THE PREFERRED EMBODIMENT

Figures 1, 2, 3, 4, 5, 6:
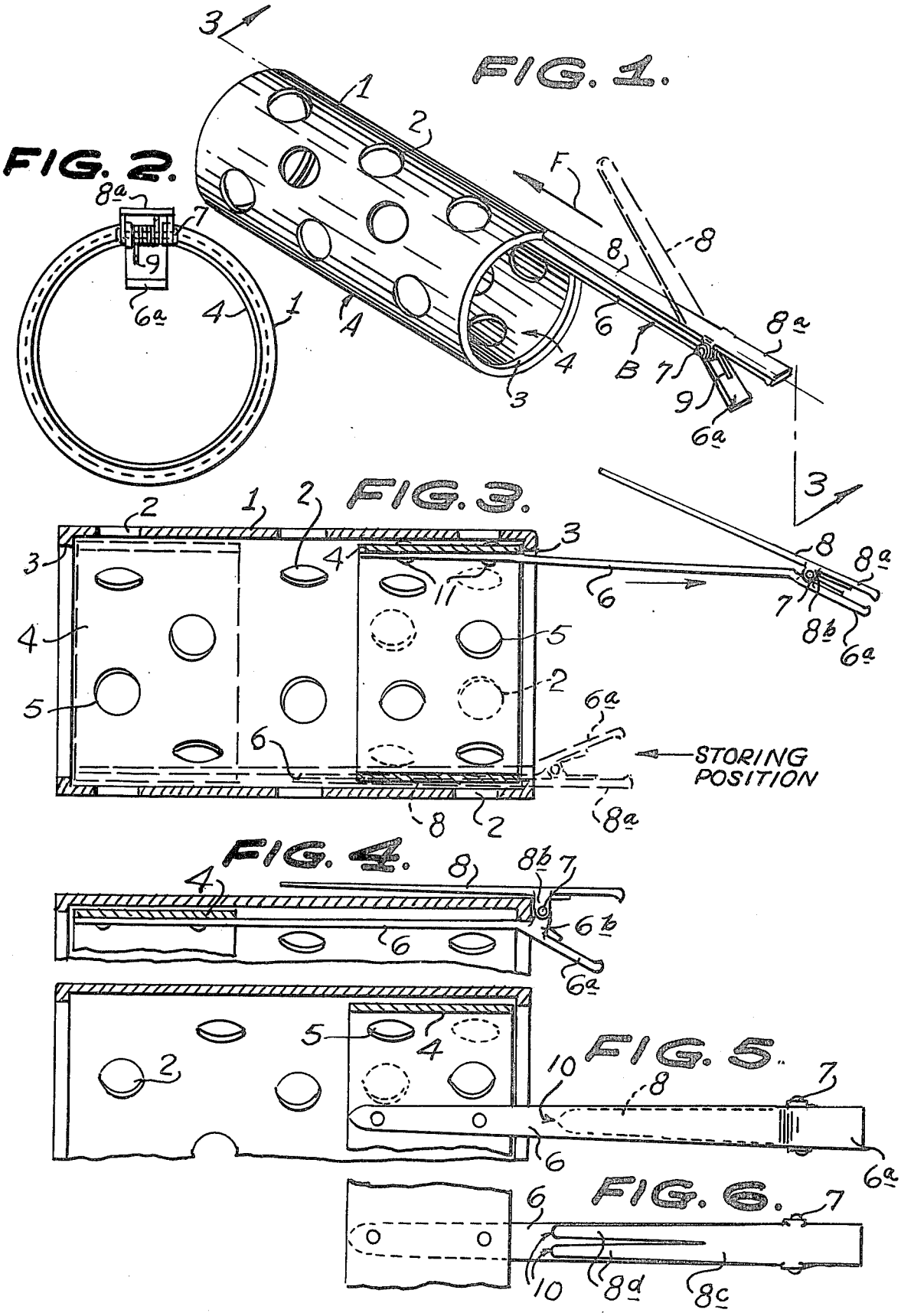
FIG. 1 is a perspective view of a roller and clip assembly of the present invention.
FIG. 2 is an end view of the roller and clip assembly, viewed in the direction of the arrow F in FIG. 1.
FIG. 3 is an axial section of the roller and clip assembly, taken on the line 3—3 of FIG. 1.
FIG. 4 is a partial axial section of the roller and clip assembly with the clip in working position.
FIG. 5 is a partial axial section of the roller and clip assembly with the clip viewed in elevation from the underside.
FIG. 6 is a partial elevation of a modified form of clip, seen from above.

Referring to FIGS. 1 to 5, the roller and clip assembly comprises a roller generally designated by reference "A", and a clip generally designated by reference "B".

The roller is a generally cylindrical hollow body 1 having in its cylindrical wall a plurality of apertures 2, as is conventional in hair curling rollers, for passage of air for drying of the hair. At each end of the body 1 there is a radially-inwards directed flange 3 which acts as a limiting stop for a clip in a manner described below. The flange need not be entirely about the circumference of the body 1, and could be replaced by a plurality of angularly-spaced lugs, or a single radially-inwards directed stop. Each end of the body 1 is otherwise open.

Within the body 1 there is disposed a slider 4 in the form of an open-ended cylindrical member having apertures 5 which can be aligned with the apertures 2. The external diameter of the slider 4 is somewhat less than the internal diameter of the body 1, so as to be an easy sliding fit with clearance within the body 1, but is nevertheless greater than the diametral opening at each end of the body 1, whereby the slider is freely slidable in the body 1 but is captive therein and cannot emerge therefrom at either end of the body 1 unless by manual extraction by deformation of the material.

On the slider 4 there is mounted an elongated leg 6 which is secured by two rivets 11 to the inside of the cylindrical wall of the slider, so as to extend approximately parallel to the axis of the slider. At its end remote from the slider, the leg 6 has a portion **6*a* bent to form a first handle, and a pair of lugs 6*b* upturned on the portion 6*a* to provide a bearing for a hinge pin 7. On the hinge pin 7 there are engaged the lugs 8*a* of a handle 8*a* of a movable arm 8 positioned generally parallel to the leg 6. About the hinge pin 7, with the axial space between the lugs, there is disposed a coiled spring 9 having its ends engaged one with the handle 6*a* and the other with the handle 8*a* to urge the arm 8 in the direction of the leg 6, i.e. to form a clip for the hair. In FIG. 1, the arm 8 is shown in full lines in the closed position, and in broken lines in the open position. The leg 6 and the arm 8 are made of metal, and the length of the leg 6 ensures a certain degree of resilience. In the position shown in FIG. 3, the clip B is fully withdrawn, in the position shown in full lines. The storing position is shown in broken lines, and it can be seen that, with slight deformation of the leg 6, the arm 8 is accommodated between the leg 6 and the internal surface of the cylindrical wall of the body 1**.

Referring to FIG. 4, which shows the working position of the clip B, the arm 8 lies externally of, and approximately parallel to, the external cylindrical surface of the body 1, and can hold a tress of hair engaged between it and the body 1.

Referring to FIG. 6, there is shown an alternative form of arm 8*c* having two branches 8*d*, 8*d* which can be engaged into the tress of hair in the manner of a hairpin, the construction being otherwise identical to that described for FIGS. 1 to 5.

In both constructions, the arm 8 or 8*c* has a rounded end 10 to assist penetration into the hair if required, according to the method adopted by the user.

The operation of the device is as follows:

Assuming that the device is being used by a hairdresser in dealing with a customer's hair, the hairdresser removes one of the devices from a suitable storage container, or a heater as the case may be, the device then having the clip B in the stored position shown in broken line in FIG. 3. He then places the roller A against the tip of the hair strands to be rolled, and in practice the placing and rolling would be carried out in the same continuous movement. After the hair has been placed and rolled up on the roller A, the clip B is then pulled out axially into the withdrawn position shown in full lines in FIG. 3. The handle portions 6*a* and 8*a* are pressed together with the finger and thumb, and this causes the arm 8 to be opened away from the leg 6. The clip B is then pushed in again axially until it reaches the working position shown in FIG. 4, in which the arm 8 then overlies the strands of hair and holds them firmly against the outside of the roller A. According to the method preferred by the hairdresser, the arm 8 may overlie all of the strands of hair, or may engage between the strands. Thus, after rolling of the hair onto the roller A, the action of engagement of the clip B consists only of three simple movements of withdrawal, opening, and returning, performed readily with the finger and thumb of one hand.

These operation procedures permit the hairdresser to work in a more efficient and effective manner with considerable time and effort saved in the setting and styling of the hair.

I claim:

1. A hair rolling and holding device, for use in curling the hair, comprising in combination:

(i) a hollow cylindrical roller having air aperatures therethrough and open at both ends, capable of receiving strands of hair wound externally about it, (ii) a clip to engage with and retain strands of hair wound about said roller, said clip including:

(a) a tubular slider having aperatures therethrough, slideably mounted on the interior wall of said roller for movement axially of said roller between a first end position of movement and a second end position of movement, (b) an elongated leg extending axially from said slider, (c) an arm being pivotally mounted on said elongated leg remote from said slider and extending axially towards said slider, and (d) resilient means tending to pivot said arm towards said elongated leg, the extent of axial movement of said slider and the positioning and length of said arm being such that in said first end position said arm is withdrawn axially from the region of the hair-receiving surface of said roller, and in said second end position of movement said arm overlies said hair-receiving surface to engage with strands of hair wound thereon.

2. A hair rolling and holding device, as claimed in claim 1, wherein said elongated arm is resiliently deformable such that, upon movement of said slider into said second end position of movement, said arm may be forced radially inwardly to the extent that it may pass within said roller in a stored condition of the clip.

3. A hair rolling and holding device, as claimed in claim 1, wherein said resilient means is a coiled spring acting between said arm and said legurging said arm towards said leg.

4. A hair rolling and holding device, as claimed in claim 2, wherein said arm and said leg each include a handle portion, said handle portions being in aligned and overlying positions to permit grasping between the finger and thumb of an operator.

5. A hair rolling and holding device, as claimed in claim 1, wherein said roller has a cylindrical internal wall, and wherein said slider is a hollow cylinder positioned with radial clearance within said roller.

6. A hair rolling and holding device, as claimed in claim 5, wherein said roller and said slider have a plurality of said air aperatures of similar size and positioning such that, by appropriate rotation of said slider when in its second end position of movement said aperatures of said roller and slider may be made to coincide.

7. A hair rolling and holding device, as claimed in claim 1, wherein said roller includes stop means projecting radially inwards thereof and positioned to be abutted by said slider and limit axial movement of said slider into its first and second end positions.

* * * * *